US005172974A

United States Patent [19]

Riban

[11] Patent Number: 5,172,974

[45] Date of Patent: Dec. 22, 1992

[54] ILLUMINATION DEVICE

[76] Inventor: Robert C. Riban, 224 S. Villa Ave., Addison, Ill. 60101

[21] Appl. No.: 806,227

[22] Filed: Dec. 13, 1991

[51] Int. Cl.[5] ..... F21V 33/00

[52] U.S. Cl. ..... 362/109; 362/23; 362/190

[58] Field of Search ..... 362/109, 190, 191, 157, 362/23, 253

[56] References Cited

U.S. PATENT DOCUMENTS

| | | | |
|---|---|---|---|
| 1,945,956 | 2/1934 | Rowell | 362/191 |
| 4,432,042 | 2/1984 | Zeller | 362/183 |
| 4,885,667 | 12/1989 | Selden | 362/253 |
| 4,893,222 | 1/1990 | Mintzer | 362/109 |
| 4,905,127 | 2/1990 | Kaminski | 362/109 |
| 4,949,230 | 8/1990 | Burmeister | 362/109 |

*Primary Examiner*—James C. Yeung
*Assistant Examiner*—Alan B. Cariaso
*Attorney, Agent, or Firm*—Richard C. Litman

[57] ABSTRACT

An illumination device for illuminating the keypad of a handheld remote control device. This illumination device consists of a base which is adapted to be mounted on the remote control device. A light source extends from the base by means of a flexible arm to enable the user to direct the pattern of light on the keypad of the remote control at a variety of angles offering the most enhanced visibility. The flexible arm also enables the user to direct the pattern of light to objects or areas other than the remote control. In addition, the illumination device is mounted in such a way that it is not limited to the size of the remote control.

17 Claims, 1 Drawing Sheet

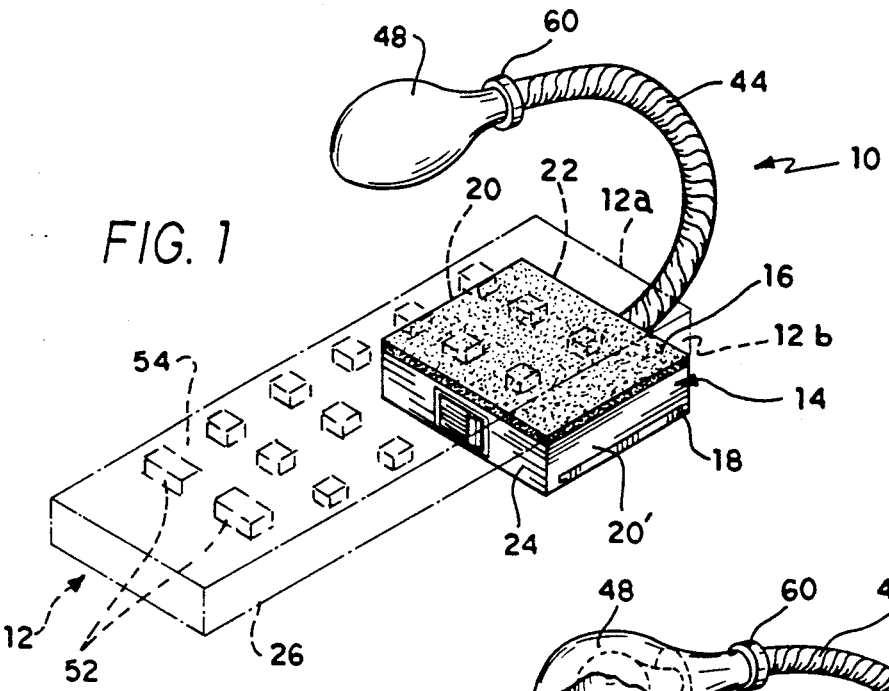
FIG. 1
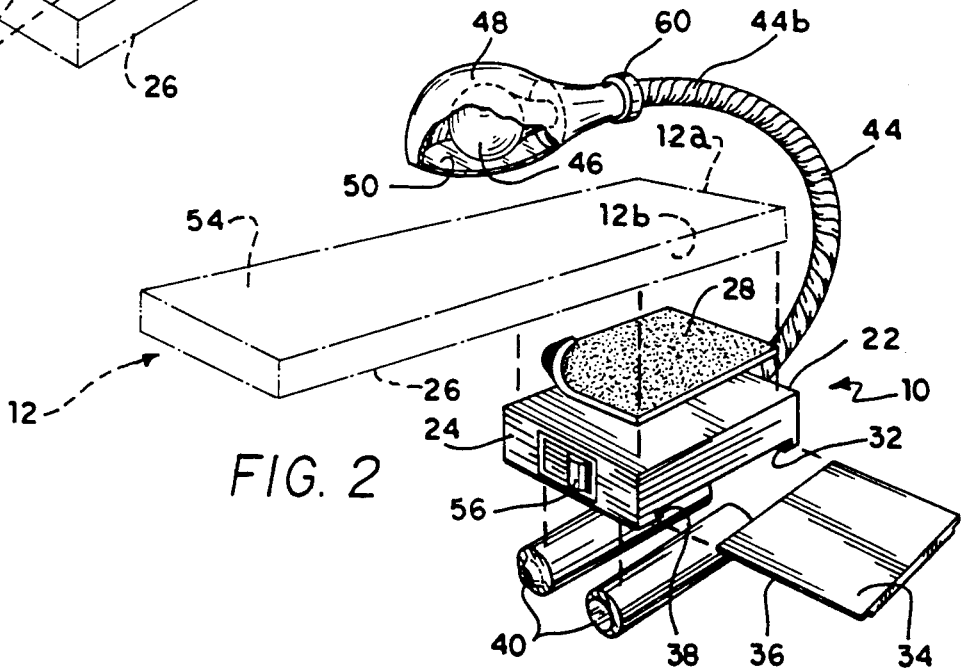
FIG. 2
FIG. 3
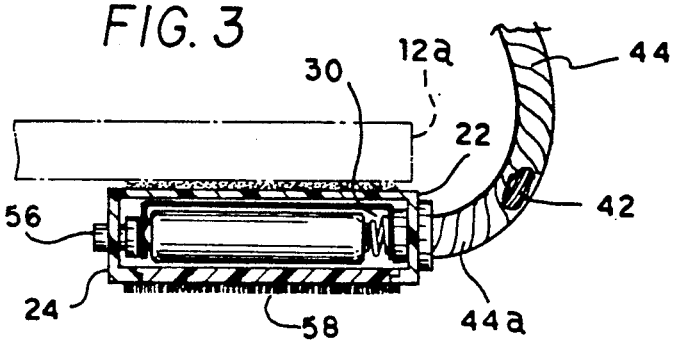

ILLUMINATION DEVICE

BACKGROUND OF THE INVENTION

The present invention relates generally, to a portable lighting means and more particularly, to an illumination device provided with a fastening means facilitating its mounting to existing handheld remote control apparatus, such as used with TVs, VCRs, etc. The illumination device provides illumination of the key pad of the handheld remote control device which would otherwise be non-illuminated.

DESCRIPTION OF THE RELATED ART

Handheld remote controls, which are generally not illuminated, are difficult to see in a inadequately illuminated environment. It is known to provide lighting devices which generally aid the user in overcoming visibility problems. U.S. Pat. No. 4,905,127 to KAMINSKI discloses a self-contained, elongated, low profile illumination device which is strapped to a remote control at one end. This device limits the uniform distribution of light over the entire keypad. U.S. Pat. No. 4,893,127 to MINTZER includes a base member which is adapted to hold a handheld remote control device. The elongated, low profile light source extends from the base along the side of the handheld remote control and emits an unequal distribution of light over the entire keypad. Both of the above devices have localized light sources thereby not producing an optimum light distribution. Examples of prior art apparatus which provide a light source attached to an arm will be found in U.S. Pat. No. 4,432,042 to ZELLER and which depicts a light source mounted on a standard which pivots on a base. U.S. Pat. No. 4,885,667 to SELDEN discloses to a light source mounted on a flexible arm and a magnifying lens both mounted on a member which has a clamp to enable the user to fasten the member to a structure.

SUMMARY OF THE INVENTION

By the present invention, a self-contained illumination device is presented which mounts to the bottom of various sizes of handheld remote controls by suitable attaching means.

A base is provided which accommodates electrical batteries to supply current to the light source. The current can be controlled and the light source selectively actuated by an electrical switch as mounted on the base or adjacent the light source lens. A flexible arm is connected at one end to the base with the other end leading to and affixed to a rotatable reflective lens which accommodates a means for accepting a light producing element. When the base is mounted upon the bottom of the remote control device and the switch is actuated, the flexible arm can be adjusted to direct the source of light to any point on the keypad illuminating the keys and providing optimal visibility even in an environment where ambient light levels would otherwise not permit the user to visualize the keypad. The flexible arm also enables the user to direct the light to objects or areas other than the surface of the remote control device.

Accordingly, one of the objects of the present invention is to provide a self-contained and selectively actuated illumination device to facilitate illuminating the keypad of a handheld remote control device. Another object of the present invention is to provide a base that may be adapted to be mounted on a handheld remote control device regardless of the size of the remote control.

It is a further object of the present invention to provide a flexible arm for the light source which may direct the light at any angle toward the keypad producing enhanced visibility of the keys. It is still another object of the present invention to provide a flexible arm for the light source which enables the user to direct the light to objects or areas other than the keypad of the remote control device.

With these and other objects in view which will more readily appear as the nature of the invention is better understood, theinvention consists in the novel construction, combination andassembly of parts hereinafter more fully described, illustrated and claimed with reference being made to the attached drawings.

BRIEF DESCRIPTION OF THE DRAWING

FIG. 1 is a top perspective of the illumination device according to the present invention as it appears mounted on a handheld remote control.

FIG. 2 is a exploded top perspective view of the device shown in FIG. 1.

FIG. 3 is a partial vertical cross sectional view of the base.

Similar reference characters designate corresponding parts throughout the several figures of the drawings.

DESCRIPTION OF THE PREFERRED EMBODIMENT

Now, referring to the drawing, particularly FIG. 1, the illumination device 10, adapted to be mounted upon the handheld remote control 12, includes a base member 14, preferable produced of a plastic material, comprising a top wall 16, a bottom wall 18, and peripheral walls including two side panels 20 and 20', a front wall 22, and a rear wall 24. At least the top and bottom panels 16,18 are planar, for reasons which will become obvious hereinafter. The width of the base member 14 is preferably comparable to that of a typical remote control unit as the top panel 16 is adapted to be affixed to the undersurface 26 of the remote control 12. Most conveniently, this attachment is accomplished by means of a non-permanent attachment, such as the illustrated double-faced adhesive pad 28. Alternative means may comprise mating hook and loop strips respectively attached to the cooperating surfaces 16,26. In this manner, the illumination device 10 may be readily switched to different remote control units as desired.

The base 14 is provided with an interior cavity 30 accessible from a bottom opening 32 that is normally enclosed by a removable panel 34. As shown most clearly in FIG. 2, this panel is laterally slidably attachable through mating tongue and groove elements 36,38 to provide a co-planar undersurface 18 when attached to the remainder of the base member. The cavity 30 is adapted to contain a suitable source of DC power, preferably in the form of dry cells 40—40, together with appropriate well known circuitry, including wiring 42, to deliver current through a flexible goose-neck arm 44, terminating in a light source or bulb 46 as contained within a suitable reflector 48. The arm 44 includes a lower end **44*a* attached to the front wall 22, either laterally centered or offset, and an opposite free or upper end 44*b*. Alternatively, the reflector 48 may include a lens 50**, such as a translucent member serving as a light diffuser.

With the above construction in mind, the attachment and use of the invention may now be related. Regardless of the size or type of remote control 12, the illumination device 10 is readied for attachment to the control undersurface 18 by peeling off any protective cover sheet (not shown) which may initially overlie the adhesive pad 28 to allow fixation of the base member 14 to the control undersurface by pressure contact therebetween. Remote controls oeprate by emitting an invisible/silent energy source such as ultrasonic or infrared signals which are interpreted by the device being controlled. This emission usually is through a window provided in the front face 12*a* of the control. If the device 10 interferes with the signal transmission, the base member 14 may be rotated ninety degrees before attachment so that the flexible arm 44 passes one side wall 12*b* of the control instead of the front wall 12*a*.

In any case, with the device 10 affixed to the remote control 12, the user may clearly identify the numerous control buttons or switches 52 on its top face 54, even in subdued light, by turning on the light bulb 46 and manipulating the displaceable arm 44. This is achieved by actuating a switch 56 on one of the walls of the base member, such as on the rear wall 24. The length of the flexible arm 44 is chosen to insure that the lamp 46 may be positioned substantially above the center of the top face or keypad 54 of the control. In this manner, full illumination of the keys 52 is achieved, even in total darkness, so that the user may clearly identify all of the control buttons. The most desirable elevation and angle of the lamp housing or reflector 48 is selected, in accordance with the ambient light and the location of the user's eyes.

The reflector 48 is preferably joined to the free end of the arm 44 by a slip joint 60 permitting of full rotation of the reflector so as to allow use of the illumination provided by the lamp 46 for other purposes, when needed. With this arrangement, emergency lighting is available for other uses when called for.

Replacement of the batteries 40 is easily accomplished, even with the device 10 affixed to a remote control 12, merely by slidably removing the base cover 34 as shown in FIG. 2. Alternatively, this base cover may be provided with an anti-slip material, such as rough fabric 58 or one component of hook and loop fastening material, to provide a more positive engagement with the arm of a chair or the like.

I claim:

1. An illumination device attachable to the undersurface of a remote control having an uppermost keypad comprising:

a base member having a top wall, bottom wall and a plurality of peripheral walls;

a flexible arm attached to one of said peripheral walls and terminating in an upper end, a light bulb adjacent said upper end;

said base member provided with a compartment containing a power source and circuitry leading to said light bulb;

attachment means intermediate said remote control undersurface and said base member top wall affixing said base member beneath said remote control;

said flexible arm displaceable to position said light bulb substantially centrally above said remote control keypad to fully illuminate said keypad;

switch means operable to activate and deactivate said circuitry between said power source and light bulb;

said base member includes a removable bottom panel to provide access to said compartment containing said power source; and said removable bottom panel includes an anti-slip means.

2. The illumination device as defined in claim 1, wherein said uppermost keypad of said remote control includes a plurality of control buttons or switches.

3. The illumination device as defined in claim 1, wherein said base member is constructed of plastic material.

4. The illumination device as defined in claim 1, wherein said light bulb is adjacent a reflector.

5. The illumination device as defined in claim 1, wherein said attachment means intermediate said remote control and said base member including a non-permanent attachment.

6. The illumination device as defined in claim 1, wherein said switch means located on one said peripheral wall.

7. The illumination device as defined in claim 4, wherein said relfector includes a lens.

8. The illumination device as defined in claim 4, wherein said reflector includes a slip joint permitting of rotation of said reflector permitting illumination of areas other than said remote control.

9. The illumination device as defined in claim 1, wherein said removable bottom panel is laterally slidably attachable through mating tongue and groove elements.

10. The illumination device as defined in claim 1, wherein said power source is a DC source of power.

11. The illumination device as defined in claim 10, wherein said DC power source is in the form a dry cell.

12. The illumination device as defined in claim 10, wherein said DC power source is of the form of a plurality of dry cells.

13. An illumination device attachable to the undersurface of a remote control having an uppeermost keypad comprising:

a base member having a top wall, bottom wall and a plurality of peripheral walls;

a flexible arm attached to one of said peripheral walls and terminating in an upper end, a light bulb adjacent said upper end, a reflector adjacent said light bulb, a slip joint permitting rotation of said reflector permitting illumination of areas other than said remote control;

said base member provided with a compartment containing a power source and circuitry leading to said light bulb, a removable bottom panel providing access to said compartment;

non-permanent attachment means intermediate said remote control undersurface and said base member top wall affixing said base member beneath said remote control;

said flexible arm displaceable to position said light bulb substantially centrally above said remote control keypad to fully illuminate said keypad;

switch means operable to activate and deactivate said circuitry between said power source and light bulb, said switch means located on one of said peripheral walls; and said removable bottom panel includes an anti-slip means.

14. The illumination device as defined in claim 13, wherein said base member is constructed of plastic.

15. The illumination device as defined in claim 13, wherein said reflector includes a lens.

16. The illumination device as defined in claim 13, wherein said removable bottom panel is laterally slidably attachable through mating tongue and groove elements.

17. The illumination device as defined in claim 15, wherein said power source is of the form of a plurality of DC dry cells.

* * * * *